US006530677B1

(12) United States Patent
Mori et al.

(10) Patent No.: US 6,530,677 B1
(45) Date of Patent: Mar. 11, 2003

(54) METHOD OF MANUFACTURING A WIRE HARNESS, AND A WORK-PERFORMING INSTRUCTION APPARATUS THEREFOR

(75) Inventors: Hiroto Mori; Yoshikazu Taniguchi, both of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/680,292

(22) Filed: Oct. 6, 2000

(30) Foreign Application Priority Data

Oct. 7, 1999 (JP) ..... P11-286676
Jan. 13, 2000 (JP) ..... P2000-004326

(51) Int. Cl.[7] ..... F21V 33/00

(52) U.S. Cl. ..... 362/286; 362/33; 362/89; 362/287; 269/11

(58) Field of Search ..... 362/33, 89, 286, 362/287; 269/11

(56) References Cited

U.S. PATENT DOCUMENTS

| | | | | |
|---|---|---|---|---|
| 2,301,788 A | * | 11/1942 | Patton et al. | 260/11 |
| 2,805,471 A | | 9/1957 | Lowden | |
| 4,190,890 A | | 2/1980 | Marx | |
| 4,261,555 A | * | 4/1981 | Adams | 269/11 |
| 5,127,062 A | | 6/1992 | Cerda | |
| 5,198,983 A | | 3/1993 | Blake et al. | |
| 6,169,934 B1 | | 2/2001 | Nakayama et al. | |

FOREIGN PATENT DOCUMENTS

JP 9-147641 6/1997

OTHER PUBLICATIONS

English Language Abstract–9–147641.

* cited by examiner

*Primary Examiner*—Sandra O'Shea
*Assistant Examiner*—Ronald E. DelGizzi
(74) *Attorney, Agent, or Firm*—Greenblum & Bernstein, P.L.C.

(57) ABSTRACT

A method and apparatus for instructing a procedure for manufacturing a wire harness are provided. A plurality of work positions is simultaneously illuminated with the visible light, and a procedure related to each work position is displayed with an optical image formed by scanning the work positions. Optical images may be consecutive numerical values formed of the visible light in correspondence to the order of works, or an outline drawing G of the wire harness WH may be displayed with an optical image formed of the visible light. Thereby, it is possible to display the order of stages without detecting the progress of an operator's work one by one. Further, utilization of the optical image allows the order of stages to be recognized easily and prevents errors from being made. Furthermore, a first holder pivotally holds a light source on a first axis. A light source-driving member for pivoting the light source on the first axis is provided on the first holder. An elastic member for preventing a backlash of a reduction gear connected to the light source-driving member is provided between the light source-driving member and the light source. The light source-driving member is interlocked with a holder-driving member for pivoting the first holder such that a to-be-processed portion of a wire harness related to a work procedure and a component part-accommodating portion related thereto are illuminated simultaneously in pairs with visible light.

30 Claims, 11 Drawing Sheets

METHOD OF MANUFACTURING A WIRE HARNESS, AND A WORK-PERFORMING INSTRUCTION APPARATUS THEREFOR

CROSS-REFERENCE TO RELATED APPLICATIONS

The present application is related to commonly owned U.S. application Ser. No. 09/628,057, filed Jul. 28, 2000, and is hereby expressly incorporated by reference in its entirety.

BACKGROUND OF THE INVENTION

1. Field of the Invention

The present invention relates to a method of manufacturing a wire harness and to a work-performing instruction apparatus therefor.

2. Description of Background Information

In manufacturing a wire harness, a plurality of electric wires is wired on a work table called a wiring plate to connect connectors to a bundle of the wired electric wires, tape them, and mount protective components thereon. The wire harness may have a complicated configuration, a large number of components may be installed on the wire harness, and the processing stages may be diverse. Therefore, various display techniques for displaying a work procedure have been proposed.

Disclosed in Japanese Laid-Open Patent Application No. 9-147641 is a technique for instructing the order of wiring the electric wires on a wiring plate and component installing positions by using visible light such as laser beams. Generally speaking, the display technique utilizes a guide apparatus capable of emitting visible light onto the wiring plate in an XY-direction to illuminate a wiring path and holding jigs of a wire harness with the visible light, in accordance with the order the electric wires are to be wired on the wiring plate. As apparent from the description in the above noted Japanese the publication, a predetermined work position is illuminated with the visible light. After the work at the displayed work position terminates, a subsequent work position is illuminated with the visible light. This procedure is repeatedly performed until the wiring harness work is completed.

However, the emission of the visible light according to the work order necessitates detection of termination of the operator's work at each stage. Thus, a troublesome switching operation must be performed, which requires a switching detection device to have a complicated construction.

That is, in the event that there are N necessary stages for manufacturing the wire harness on the wiring plate, it is necessary to emit the visible light for each of N irradiation positions. In this case, it is necessary to detect whether the operator's work is progressing in each stage and to input data of the progress of the work to a control unit to switch the illumination positions. Therefore, many sensors for detecting the termination of the work in each stage are required, and the detection process is complicated. That is, the conventional construction is not suitable for a wire harness that requires manufacture through many work stages.

It is conceivable to switch the illumination position with a timer. But in this case, it is necessary to set/alter switching times for each stage, which becomes complicated. In addition, if a switching time is set for each stage, a time lag may occur between an operator's actual work time and the set time.

Further, a process for performing wiring work by use of a timer may be burdensome and unpleasant for the operator and may not necessarily improve work efficiency.

SUMMARY OF THE INVENTION

The present invention has been made in view of the above-described disadvantages. Thus, it is an object of the present invention to provide a method of manufacturing a wire harness and a work-performing instruction apparatus capable of displaying a manufacturing procedure of many stages with a simplest possible construction.

To achieve the above object, there is provided a method of instructing a procedure for manufacturing a wire harness by wiring electric wires on a wiring plate with visible light. A to-be-processed portion of the wire harness related to the procedure and a component part-accommodating portion related thereto are simultaneously illuminated in pairs with the visible light.

In the present invention, by emitting the visible light to a plurality of assembly positions simultaneously, the assembly order of each display position can be displayed. Thereby, it is possible to display the order of assembly without detecting the progress of an operator's work at each stage. In the present invention, the word "simultaneously" is not necessarily used in the strict sense of the word, but may be used in a sense that seeing the linear locus of the visible sight, the operator understands that the to-be-processed position and a component receptacle have been displayed at the same time.

As the mode of illuminating the assembly position with the visible light, it is preferable that a plurality of positions are scanned and illuminated with a single light source. In this case, a plurality of assembly positions can be displayed simultaneously. Accordingly, an operator can perform an assembly operation without being restricted by time, and a display condition can be appropriately altered according to the progress of the operator's work.

In another aspect of the present invention, the to-be-processed portion of the wire harness and the component part-accommodating receptacle may be illuminated simultaneously in pairs with visible light emitted by a plurality of light sources.

As another embodiment of the present invention, the visible light may be emitted by a light source to a required portion in only a standard assembly time period set in correspondence with the procedure.

As still another embodiment of the present invention, the visible light may be emitted simultaneously linearly by pivoting a light source. In this manner, the to-be-processed portion of the wire harness and the component part-accommodating portion can be illuminated in pairs with visible light of a single light source. Thus, it is possible to embody the present invention with an illumination apparatus having a comparatively simple construction.

According to a further aspect of the present invention, there is provided a work-supporting instruction apparatus having a light source emitting visible light, a first holder pivotally mounting the light source on a first axis, and a light source-driving member is provided on the first holder to pivot the light source on the first axis. A second holder is provided that pivotally mounts the first holder on a second axis orthogonal to the first axis, a second holder-driving member is provided for pivoting the first holder on the second axis, and a controller is provided that controls the light source-driving member and the second holder-driving member such that a to-be-processed portion of a wire harness related to a work procedure and a component part-accommodating portion related thereto are simultaneously illuminated in pairs with the visible light.

In other aspects of the work-supporting instruction apparatus of the present invention, the to-be-processed portion may include either a portion of a wire harness or a cavity of a connector. Additionally, the apparatus may also include at least one jig mounted on a work plate to receive the connector and hold the same in a fixed position, and the jig may be operatively connected to the controller in order to feed back information to the controller regarding assembly of the component and the connector.

In this apparatus, the to-be-processed portion of the wire harness related to the work procedure and the component part-accommodating portion related thereto are illuminated simultaneously in pairs with the visible light. Therefore, the assembly order of each display position can be displayed. Preferably, an elastic member for preventing a backlash of a reduction gear connected to the light source-driving member is provided between the first holder and the light source.

In this construction, to pivot the light source, the light source-driving member is installed on the first holder, and the second holder is provided to pivotally mount the first holder thereon through the light source-driving member. Thus, the light source-driving member is cantilever-mounted on the holder-driving member. Consequently, the second holder-driving member receives the load of the light source-driving member and that of the first holder held by the second holder through the light source-driving member. Therefore, it is unnecessary to provide the holder-driving member with a backlash prevention elastic member.

In another aspect of the present invention, a method of instructing a procedure for manufacturing a wire harness by wiring electric wires on a wiring plate with visible light is provided. The method includes simultaneously illuminating a plurality of work positions with the visible light, and the procedure related to each work position is displayed with an optical image formed by scanning the work positions. Additionally, the illuminating may also include emitting the visible light to provide an illumination pattern in the shape of a cross-hair.

Thus, it is possible to display the order of stages without detecting the progress of an operator's work one by one. In the present embodiment, the word "simultaneously" is not necessarily used in the strict sense, but may be used in a sense that seeing the linear locus GA of the visible light, the operator understands that the to-be-processed position and the receptacle have been displayed at the same time. Accordingly, for example, the situation where a predetermined figure is displayed by scanning and illuminating a plurality of work positions with laser beams is included in "simultaneously" used in the present invention.

According to a further aspect of the present invention, a plurality of work positions is displayed with optical images of consecutive numerical values formed of the visible light in correspondence to the order of assembly. Thereby, sequences of assembly can be displayed simultaneously by a display made at one time.

In accordance with a further aspect of the present invention, an outline drawing of the wire harness is displayed with an optical image formed of the visible light. Thereby, it is possible to grasp the outline of the wire harness at one glance and thus even an unskilled operator makes few errors. "Outline drawing" is a concept including a drawing linearly showing the wiring path of the wire harness and a drawing of the component to be installed on the wire harness. "Outline drawing of wire harness" includes not only the one of the entire wire harness but also one of the sub-assemblies constituting the wire harness.

In another aspect of the present invention, a method is provided of instructing a procedure for connecting terminal ends of a component to a connector using visible light. The method includes simultaneously illuminating a terminal end receiving cavity of the connector and indicating the component to be connected thereto with the visible light.

In other aspects of the present invention, the method of instructing a procedure for connecting terminal ends of a component to a connector using visible light that is emitted simultaneously linearly by pivoting a light source, that is emitted simultaneously by a plurality of light sources, that is emitted by a light source to a required portion in only a standard assembly time period set in correspondence to the procedure, that is emitted by a light source to a required portion in only a standard assembly time period set in correspondence to the procedure, or that is emitted by a light source to a required portion in only a standard assembly time period set in correspondence to the procedure. Moreover, the visible light may also be emitted by a light source to provide an illumination pattern in the shape of a cross-hair.

According to another aspect of the present invention, the method of instructing a procedure for connecting terminal ends of a component to a connector using visible light may also include providing at least one jig having a portion for receiving the connector, emitting the visible light from a motor actuated light source to selectively illuminate any one of a plurality of terminal end receiving cavities in the connector, and controlling, with a control unit, actuation of the motor actuated light source to enable the selective illumination of the cavities in the connector, and simultaneously controlling, with the control unit, indicating the selected component to be connected to the connector. Additionally, the indicating of the component may include emitting light from a light source provided on a receptacle that houses the selected component simultaneously with the visible light emitted from the motor actuated light source.

In other aspects of the method of instructing a procedure for connecting terminal ends of a component to a connector using visible light of the present invention, the control unit may respond to insertion of a first terminal end of the component into the illuminated cavity to actuate the motor actuated light source to indicate another connector cavity into which a second terminal end is to be inserted and to simultaneously indicate a next component to be selected for connecting to the connector. Additionally, the control unit may also respond to insertion of a second terminal end into the another cavity to restart the instructing of the procedure until all desired components have been connected to appropriate connectors.

DESCRIPTION OF THE PREFERRED EMBODIMENTS

A first embodiment of the present invention will be described below with reference to accompanied drawings.

Figure 1:
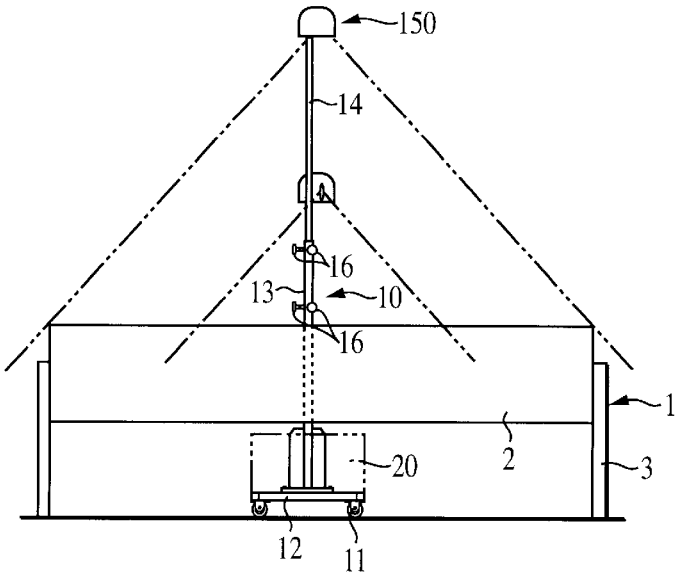
FIG. 1 is a schematic front view showing an example of an instruction apparatus capable of carrying out the method of an embodiment of the present invention.
Figure 2:
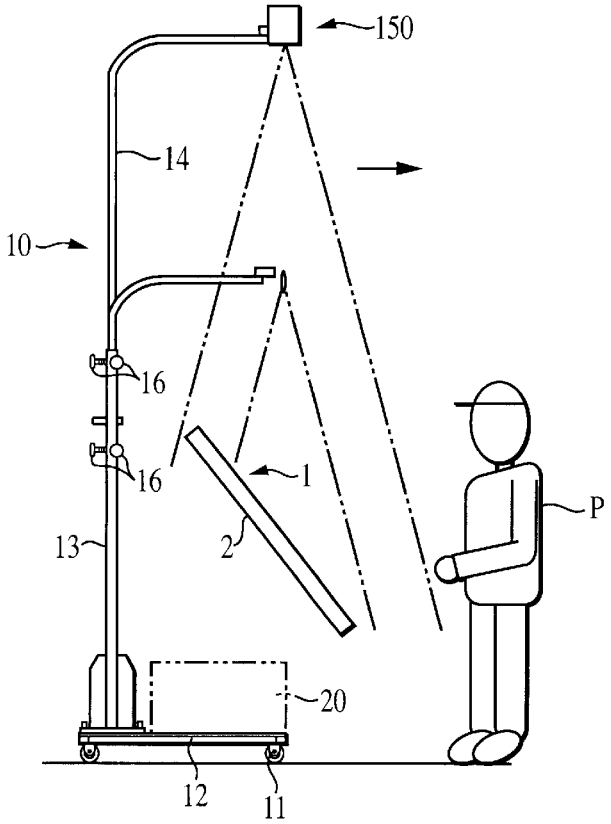
FIG. 2 is a schematic side view of the embodiment of FIG. 1.

FIG. 1 is a schematic front view showing an example of an instruction apparatus capable of carrying out the method of the present invention. FIG. 2 is a schematic side view of FIG. 1. In the description that follows, the side at which operator P (see FIG. 2) is located is designated as a front side.

As shown in FIGS. 1 and 2, an instruction apparatus 10 according to the first embodiment is used by placing it alongside a wiring support 1. In the wiring support 1, a wiring plate 2, on which a wire harness WH to be wired, is supported by legs 3. To allow the operator P to perform work easily, the wiring plate 2 is positioned with the operator's side thereof extending downwardly at angle relative to a horizontal line (see FIG. 2).

The instruction apparatus 10 includes a movable base 12 which can be movably mounted by castors 11, a cylindrical member 13 is mounted on the movable base 12 to extend upwardly therefrom, and a vertically movable supporting bracket 14 is telescopically received within the cylindrical member 13. A laser beam emission unit 150 that emits visible laser beams onto the wiring plate 2 is supported on the supporting bracket 14.

The movable base 12 is formed as a generally rectangular platform in a plan view. The movable base 12 is positioned immediately below the wiring plate 2 during use of the instruction apparatus 10. A control unit 20 that will be described later is placed on the movable base 12.

The cylindrical member 13 is fixed to the movable base 12 at one side thereof so that the cylindrical member 13 is located to the rear of the wiring base 1 during use of the instruction apparatus 10. Two groups of three set screws 16 spaced circumferentially at uniform angular intervals are installed at predetermined vertical positions of the cylindrical member 13 to adjust the vertical position of the supporting bracket 14 telescopically received within the cylindrical member 13.

The supporting bracket 14 is rod-shaped and includes a portion bent at approximately 90 degrees to form a generally horizontally extending portion. The vertically extending portion is telescopically received within the cylindrical member 13, whereas the horizontal portion is positioned above the wiring plate 2.

Figure 3:
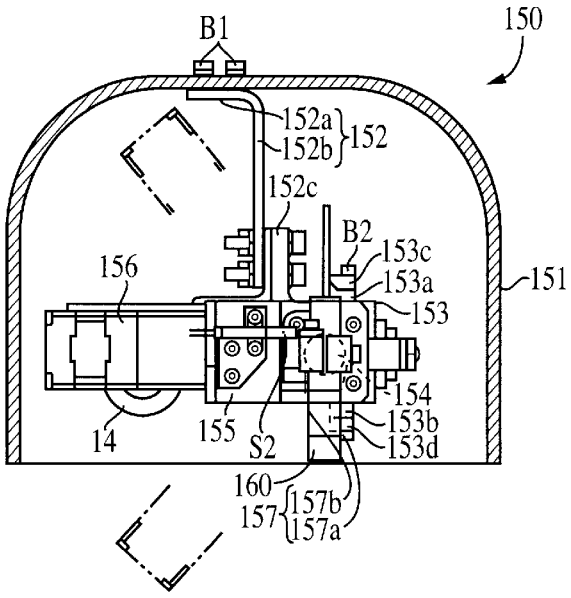
FIG. 3 is front sectional view showing a light beam emission unit according to the embodiment shown in FIG. 1.
Figure 4:
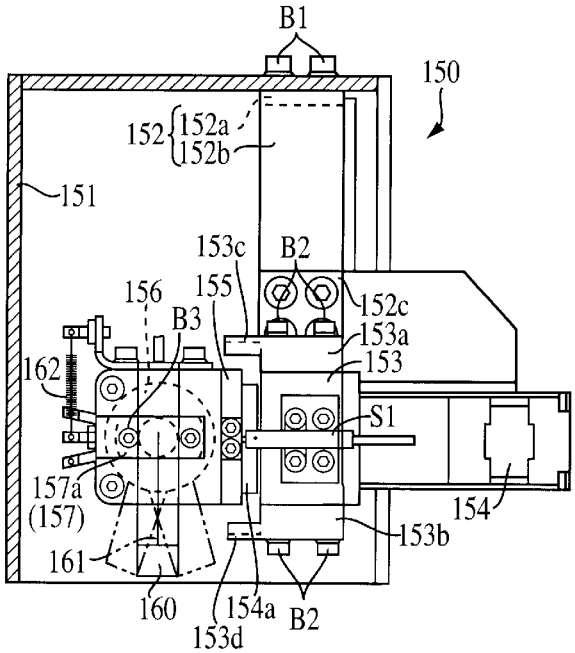
FIG. 4 is a side sectional view showing the light beam emission unit according to the embodiment shown in FIG. 1.
Figure 5:
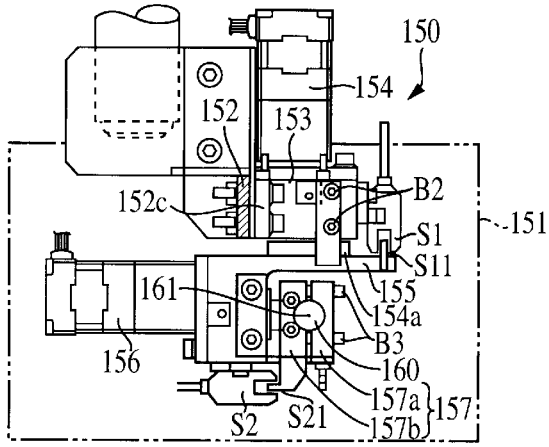
FIG. 5 is a plan view showing the light beam emission unit according to the embodiment shown in FIG. 1.
Figure 6:
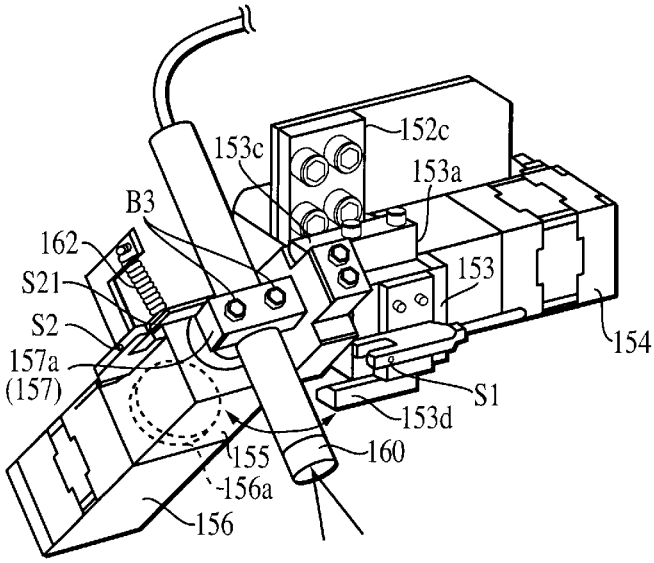
FIG. 6 is a perspective view showing the light beam emission unit according to the embodiment shown in FIG. 1.

FIG. 3 is front sectional view showing a light beam emission unit according to the embodiment of FIG. 1, FIG. 4 is a side sectional view showing the light beam emission unit according to the embodiment of FIG. 1, FIG. 5 is a plan view showing the light beam emission unit according to the embodiment of FIG. 1 and FIG. 6 is a perspective view showing the light beam emission unit according to the embodiment shown in FIG. 1.

With reference to FIGS. 3 through 6, the laser beam emission unit 150 includes a cover 151 fixed to one end of the supporting bracket 14, a stay 152 provided inside the cover 151 and extending vertically, and a holder 153 mounted on the stay 152 through an installation member 152C. An X-axis motor (holder-driving member) 154 is held by the holder 153, and an L-shaped holder 155 is pivotally moved by the X-axis motor 154. A Y-axis motor (light source-driving member) 156 is held by the L-shaped holder 155, a light source holder 157 is pivotally moved by the Y-axis motor 156, and a light source unit 160 is held by the light source holder 157.

The cover 151 is generally box-shaped and does not have a bottom. The cover 151 has a space large enough for the Y-axis motor 156 (which will be described later) to pivot.

The stay 152 has a shape of an inverted L in a front view. The shorter side 152*a* of the stay is mounted to the upper surface of the cover 151 with bolts B1, whereas the longer side 152*b* extends generally vertically inside the cover 151.

The holder 153 has a rectangular solid-shape. The X-axis motor 154 (which will be described later) is fixed to the rear surface of the holder 153 and extends generally horizontally to the rear. Spacers 153*a,* 153*b* are fixed to the upper and lower surfaces of the holder 153, respectively with bolts B2, with ends 153*c* and 153*d* thereof projecting forwardly. The end 153*c* of the spacer 153*a* and the end 153*d* of the spacer 153*b* constitute stoppers restricting the amount of rotation of the Y-axis motor 156.

The X-axis motor 154 and the Y-axis motor 156 are each formed as a stepping motor and can drive the holders 155 and 157 in opposite directions, respectively. An output shaft of the X-axis motor 154 extends generally horizontally in the front-to-back direction and is connected with the L-shaped holder 155 through a coupling 154*a* such that the L-shaped holder 155 can pivot. The L-shaped holder 155 is L-shaped in a plan view. At its home position shown in FIGS. 3 through 5, the L-shaped holder 155 supports the Y-axis motor 156 such that the output shaft of the Y-axis motor 156 is in a generally horizontal direction orthogonal to the output shaft of the X-axis motor 154. Position-detecting photoelectric sensors S1 and S2 are installed on the holders 153 and 155, respectively. The sensor S1 installed on the holder 153 detects a dog S11 installed on the L-shaped holder 155, thus detecting whether the motor 154 is stopped at its home position. The sensor S2 installed on the holder 155 detects a dog S21 installed on the light source holder 157, thus detecting whether the motor 156 is stopped at its home position.

The light source holder 157 holds the light source unit 160 disposed between a pair of clamps 157*a* and 157*b* connected to each other with bolts B3, with the clamps 157*a* and 157*b* opposed to each other in the left-to-right direction.

As shown in FIG. 4, a tension spring (elastic member) 162 is provided between the light source holder 157 and the L-shaped holder 155. The biasing force of the tension spring 162 prevents the light source unit 160 from becoming loose due to the backlash of a reduction gear 156*a* (shown in only FIG. 6) connected to the Y-axis motor 156. A backlash prevention tension spring is not provided between the L-shaped holder 155 and the holder 153. The reason is as follows: The Y-axis motor 156 is installed on the L-shaped holder 155, and the holder 153 is provided to pivotally hold the L-shaped holder 155 and the Y-axis motor 156. Thus, the L-shaped holder 155 (and Y-axis motor 156) is cantilever-mounted on the X-axis motor 154. Consequently, the X-axis motor 154 receives the load of the L-shaped holder 155 and that of the Y-axis motor 156. Therefore, it is unnecessary to provide the X-axis motor 154 with a backlash prevention elastic member.

Figure 7:
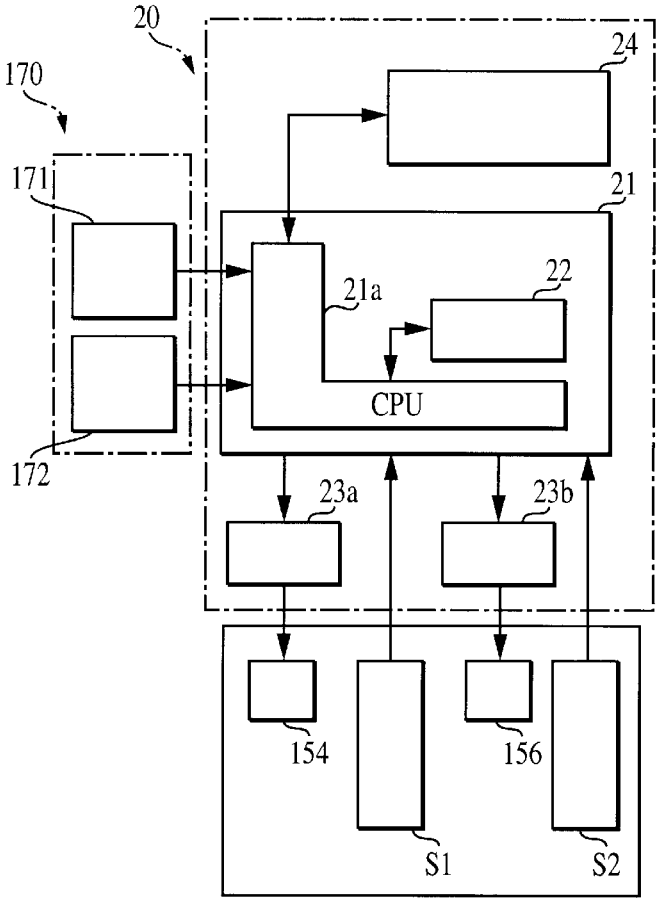
FIG. 7 schematically shows a fundamental construction for controlling motors according to the embodiment shown in FIG. 1.

FIG. 7 schematically shows the fundamental construction for controlling the motors 154, 156 according to the embodiment shown in FIG. 1.

With reference to FIG. 7, the control unit 20 accommodates a microprocessor 21. A memory 22 of the control unit 20 stores the manufacturing stages of a wire harness WH, data of an illumination position corresponding to each stage, and drive data of the motors 154, 156 corresponding to the illumination position. These data are inputted by using a personal computer (not shown). Output signals of the sensors S1 and S2 of the laser beam emission unit 150 are inputted to a CPU 21*a* of the microprocessor 21.

To drive the motors 154, 156 with high accuracy, the microprocessor 21 is connected with X-axis motor control driver 23*a* and Y-axis motor control driver 23*b* connected with the motors 154, 156, respectively. The motors 154, 156 can be selectively driven through the motor control drivers 23*a*, 23*b*, respectively.

An operation panel 24 is provided for the microprocessor 21. The operation panel 24 allows the power supply to be turned on and the light source unit 160 of the laser beam emission unit 150 to be positively turned off.

In the present embodiment, the microprocessor 21 is connected with an instruction signal output portion 171 of a connection instruction device 170 attached to the wiring plate 2 and with a continuity test signal output portion 172 of the connection instruction device 170. In manufacturing the wire harness WH, a connection instruction signal of terminal-attached connected electric wires and a continuity test signal thereof are outputted from the instruction signal output portion 171 and the continuity test signal output portion 172, respectively. Thereby, data indicating a determination made as to whether the wire harness WH being manufactured has passed the test are inputted to the control unit 20. The information can be used for support procedures that will be described later.

Figure 8:
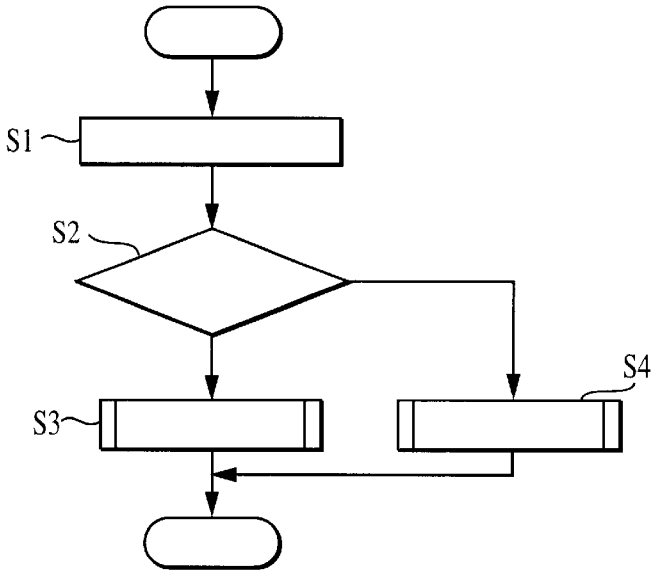
FIG. 8 is a flowchart showing an operation procedure according to the embodiment of FIG. 1.

FIG. 8 is a flowchart showing operation procedures of the present embodiment.

With reference to FIG. 8, at step S1, initial setting is executed in the control unit 20. At step S2, a mode selection is executed to switch between a normal instruction processing mode S3 in which a normal routine is executed and a teaching processing mode S4 in which input of data and alteration of setting are executed. Thus, by executing the mode selection procedure, the normal instruction processing mode S3 or the teaching processing mode S4 is selected and executed.

Figure 9:
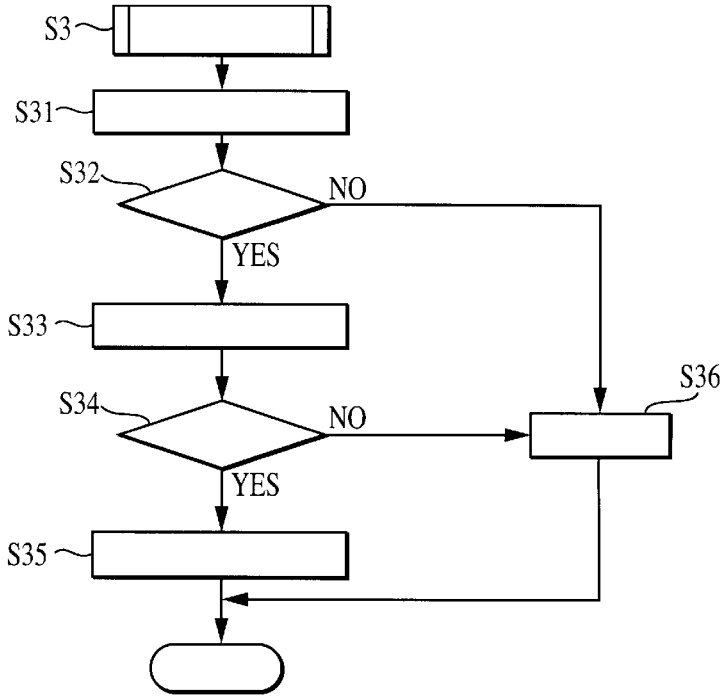
FIG. 9 is a flowchart showing the detail of a normal instruction processing mode of FIG. 8.

FIG. 9 is a flowchart showing details of the normal instruction processing mode of FIG. 8.

With reference to FIG. 9, when the normal instruction processing mode is selected, at step S31, the microprocessor 21 of the control unit 20 reads data to be displayed. In the read operation of the present embodiment, information of stages are inputted by reading an instruction signal outputted from the instruction signal output portion 171 of the connection instruction device 170. In the present embodiment, at step S32, the input information of the stage is compared with data stored in the memory 22 as to whether or not the information matches the data. If NO, the program goes to step S36 at which an error display is executed and the processing terminates. If YES at step S32, the light source unit 160 is actuated and illumination starts at step S33.

Figure 10A:
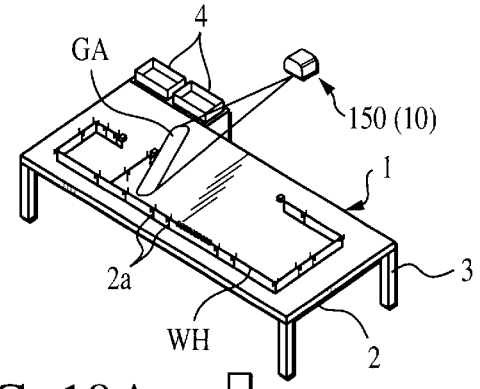
FIGS. 10(A) and 10(B) are perspective views showing typical examples of a display of the embodiment.
Figure 10B:
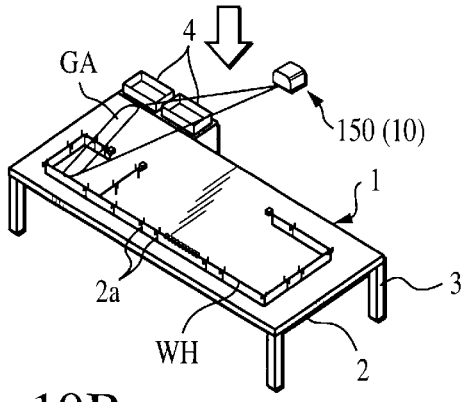
Figure 11:
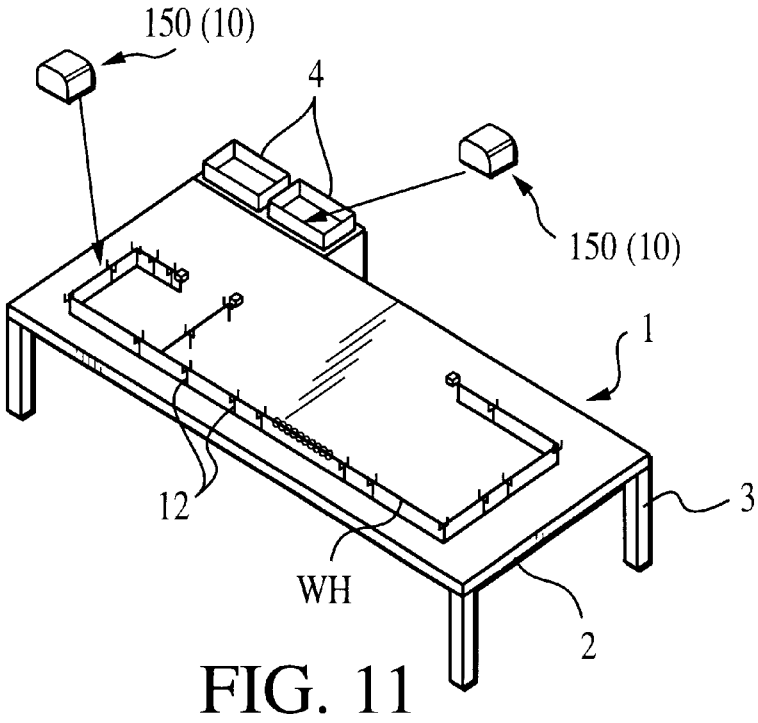
FIG. 11 is a perspective view showing another display mode to be carried out by using the instruction apparatus of FIG. 1.
Figure 12:
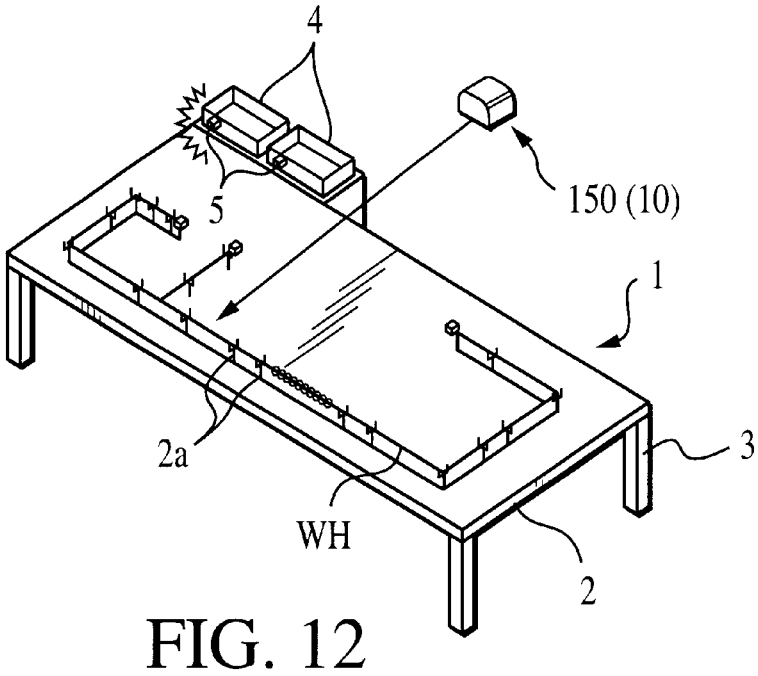
FIG. 12 is a perspective view showing still another embodiment of the present invention.

In the embodiment shown in FIG. 9, as shown in FIGS. 10–12 that will be described later, a to-be-processed portion of the wire harness WH related to the order of assembly and a component part-accommodating portion (receptacle 4) corresponding to the to-be-processed portion are displayed simultaneously in pairs with the visible light. Thus, it is possible to display the order of assembly without detecting the progress of an operator's work at each stage. In the present embodiment, a plurality of work positions can be displayed simultaneously. Accordingly, the operator can perform the work without being restricted by time, and a display condition can be appropriately altered according to the progress of the operator's work.

At step S34, the microprocessor 21 determines whether the operator has finished the work, based on an output signal of the continuity test signal output portion 172 of the connection instruction device 170. If YES at step S34, the light source unit 160 is turned off and the processing terminates at step S35. If NO at step S34, the program goes to step S36 at which an error display is executed and the processing terminates.

FIGS. 10(A) and 10(B) are perspective views showing a typical example of a display of one embodiment of the present invention. Referring to FIG. 10, reference numeral 2*a* denotes a wiring tool (a so-called U-shaped jig) for wiring the wire harness, and 4 denotes receptacles for accommodating articles for the wire harness. The receptacles 4 accommodate connectors to be installed on the wire harness, protective components, separate wiring tools 2*a*, or other components to be utilized in the wire harness assembly process.

As shown in FIGS. 10(A) and 10(B), as a support display in manufacturing the wire harness WH by using the laser beam emission unit 150, it is preferable to emit light beams such that a linear locus GA is formed between a to-be-processed position of the wire harness WH and the appropriate receptacle 4 corresponding to the to-be-processed position. In the present embodiment, the word "simultaneously" is not necessarily used in the strict sense of the word, but may also be used in a sense that upon seeing the linear locus GA of the visible sight, the operator understands that the to-be-processed position and the appropriate receptacle 4 have been displayed at the same time. Alternatively, the to-be-processed position and the appropriate receptacle 4 may actually be simultaneously illuminated.

FIG. 11 is a perspective view showing a display mode according to another embodiment of the present invention.

As shown in FIG. 11, as the work position-illuminating mode, a plurality of instruction apparatuses 10 (or laser beam emission units 150) may be provided to simultaneously illuminate the to-be-processed position and the appropriate receptacle 4 corresponding to the to-be-processed position with the visible light.

FIG. 12 is a perspective view showing still another embodiment of the present invention.

In the embodiment shown in FIG. 12, an illumination device 5, for example an LED, is installed on each receptacle 4 and can be individually turned on at a predetermined timing under the control of the control unit 20 (see FIG. 7). A plurality of stages is simultaneously displayed by simultaneously illuminating the illumination device 5 of the appropriate receptacle 4 related to a particular stage and the to-be-processed portion of the wire harness WH corresponding to the appropriate receptacle 4.

The above-described embodiments are merely examples of the present invention and the present invention is not limited to the above-described embodiments. For example, the laser beam emission unit may be constructed of a plurality of mirrors combined with each other so that display positions are scanned and illuminated with laser beams to form an optical image.

Figure 13:
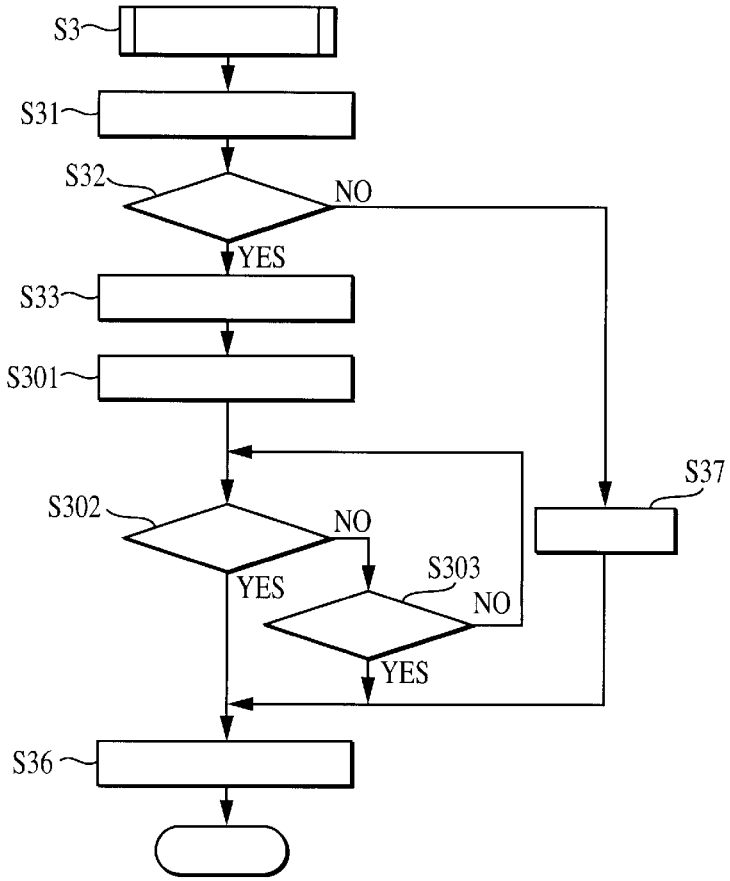
FIG. 13 is a flowchart according to another embodiment of the present invention.

The illumination timing is also not limited to that of the above-described embodiment. For example, a mode as shown in FIG. 13 may be adopted. FIG. 13 is a flowchart of another embodiment of the present invention. The same procedure as that shown in FIG. 9 is denoted by the reference numerals of FIG. 9 and the description thereof is omitted.

As shown in FIG. 13, as the procedures for setting an illumination time, a method of counting a standard set time may be carried out, as executed at step S301. The standard set time is a standard time period required for the operator to finish the assembly operation and is counted by the microprocessor 21. The operator performs a predetermined assembly operation within the standard set time, based on the illumination operation of the light source unit 160. In carrying out the method of counting the standard set time, in addition to termination of the illumination to be executed at step S302 after the standard set time elapses, it is possible to forcibly terminate the illumination manually (operation of operation panel 24) at step S303 before the standard set time elapses. Thereby, the support of the assembly operations to be made by means of the illumination can be executed in a condition suitable for the operator's work condition, which allows the work to be performed with high efficiency.

Figure 14:
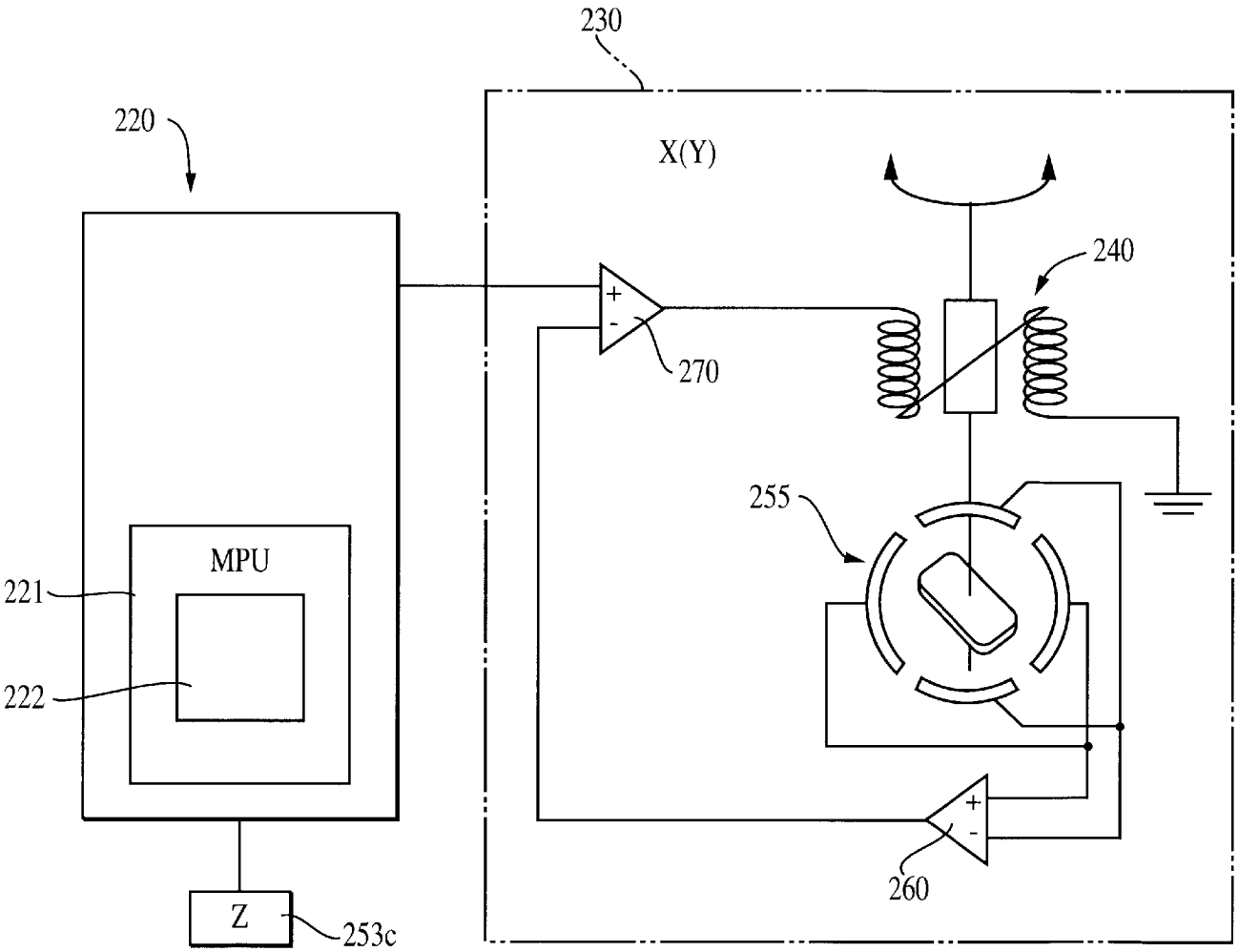
FIG. 14 schematically shows an alternative construction for controlling motors of the embodiment shown in FIG. 1.
Figure 15:
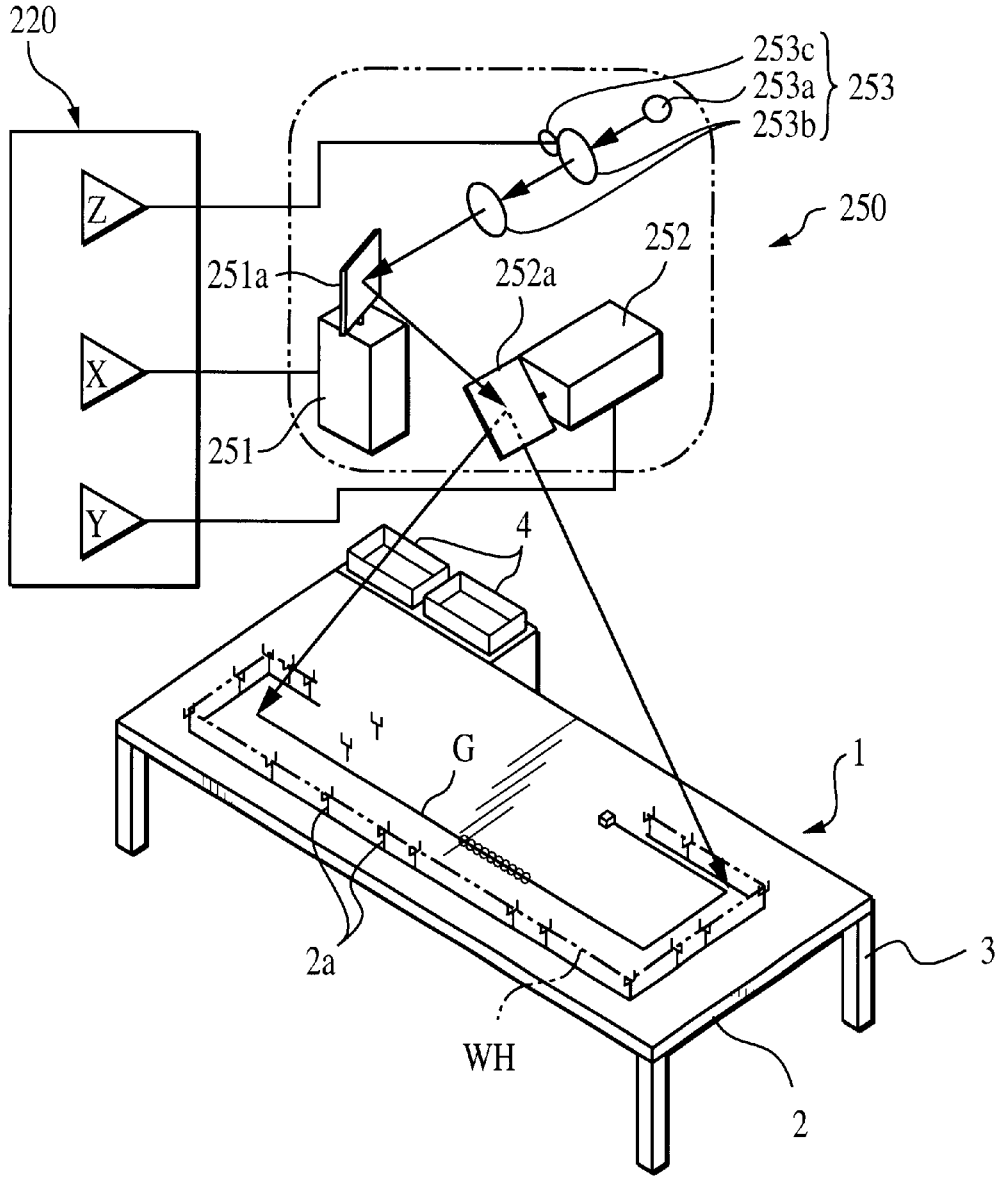
FIG. 15 is a perspective view showing a typical example of the indication of the embodiment shown in FIG. 3.

FIG. 14 schematically illustrates another embodiment of a control unit 220 and of a laser emission unit 250 similar to that of the embodiment in FIG. 1. FIG. 15 is a perspective view showing a typical example of the indication of the embodiment of FIG. 14.

With reference to FIG. 15, the laser emission unit 250 includes an X-axis unit 251 for rotating a reflection mirror 251*a* in one axial direction (X-axis direction), a Y-axis unit 252 for rotating a reflection mirror 252*a* in the direction (Y-axis direction) perpendicular to the axis of the X-axis unit 251, and a light source unit 253 emitting laser beams to the reflection mirror 251*a* of the X-axis unit 251.

As shown in FIG. 14, each of the X-axis unit 251 and the Y-axis unit 252 has a drive circuit 230 connected with the control unit 220. The control unit 220 controls each of the drive circuits 230 as follows to form a desired outline drawing G (optical image): Light emitted from a light source 253*a* of the light source unit 253 is reflected by the X-axis mirror 251*a,* and the reflected light is guided toward the wiring base 1 through the Y-axis mirror 252*a*.

The light source unit 253 has an emission element 253*a*, an optical lens 253*b*, and a focal point-adjusting servo motor unit 253*c*. Under the control of the control unit 20, the servo motor unit 253*c* is interlocked with the X-axis unit 251 and the Y-axis unit 252 to adjust the focal point of the outline drawing (optical image).

With reference to FIG. 14, the control unit 220 accommodates a microprocessor 221. A memory 222 of the control unit 220 stores the manufacturing stage of wire harness WH, data of an illumination position corresponding to each stage, and drive data (voltage, pulse, and the like) of the laser emission unit 250 corresponding to the illumination position. These data is inputted by using a personal computer (not shown). To indicate the desired outline drawing G (optical image) on the wiring plate 2 by driving the X-axis unit 251 and the Y-axis unit 252 with high accuracy, a motor control circuit 230 is provided for the X-axis unit 251 and the Y-axis unit 252. The motor control circuit 230 includes in each axis thereof a servo drive 240 controlling a rotation amount of the mirror 251*a* of the X-axis unit 251 and that of the mirror 252*a* of the Y-axis unit 252, a position sensor 255 detecting a rotation amount of the servo drive 240, a comparator 260 comparing the electric potential at the plus side and minus side of the position sensor 255 with each other, and a comparator 270 transmitting a signal (feedback) to the servo driver 240, based on an output transmitted thereto from the comparator 260 and a command signal (analog signal) transmitted thereto from the control unit 220 (these members are shown for only one axis). The control unit 220 outputs the command signal to the motor control circuit 230, based on the data stored in the memory 222 of the microprocessor 221. Thereby, it is possible to generate a precise outline drawing G (optical image) by scanning and illumination.

Referring to FIG. 15, as previously noted, reference numeral 2*a* denotes a wiring tool (so-called U-shaped jig) for wiring the wire harness, and 4 denotes a receptacle for accommodating components for the wire harness. The receptacle 4 accommodates connectors to be installed on the wire harness, protective components, and additional wiring tools 2*a*, separately.

As shown in FIG. 15, as a support display in manufacturing the wire harness with the laser emission unit 250, it is possible to display the outline drawing G (linear wiring path or outline drawing of sub-assembly or both wiring path and outline drawing of sub-assembly) of each sub-assembly constituting the wire harness WH with an optical image. Because stages are displayed with the outline drawing G, a plurality of display positions is displayed simultaneously with the optical image formed of visible light. Thus, it is possible to display the order of the stages without detecting the progress of the operator's work one by one. In the present embodiment, because the outline drawing G of the wire harness is displayed with the optical image formed of the visible image, it is possible to grasp the outline of the wire harness at one glance and thus even an unskilled operator makes few errors.

Figure 16A:
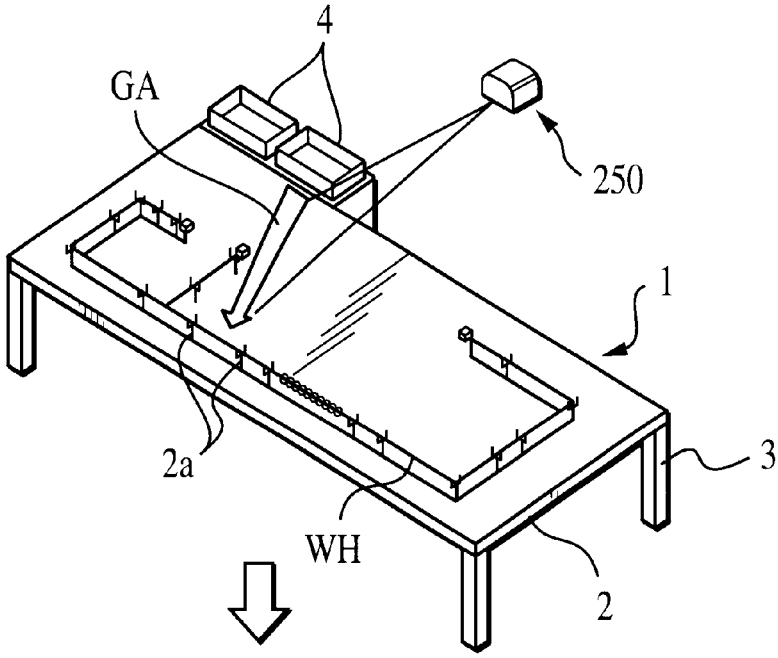
FIG. 16(A) and 16(B) are perspective views showing another display mode to be carried out by using the instruction apparatus shown in FIG. 1.
Figure 16B:
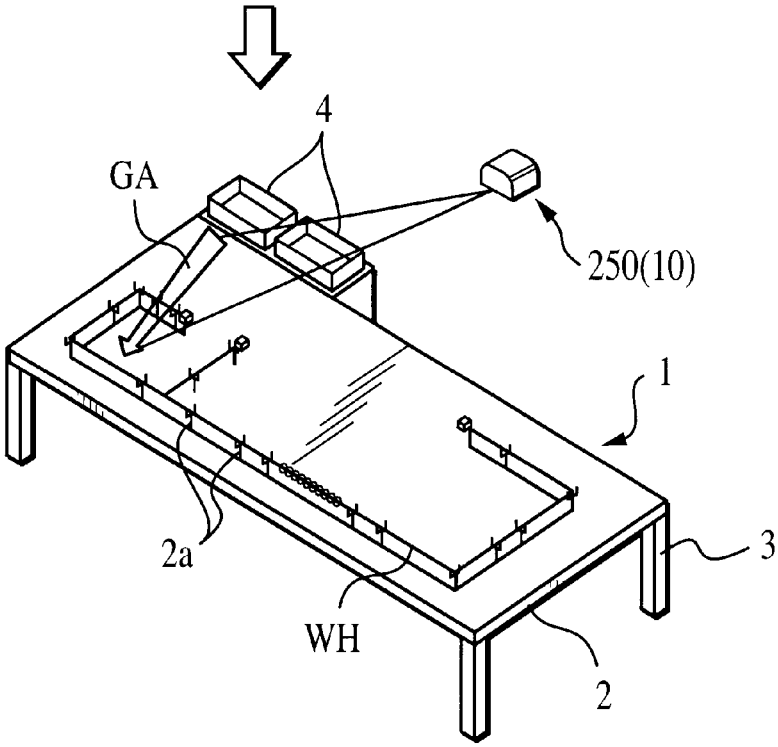

FIGS. 16(A) and 16(B) are perspective views showing another display mode to be carried out by using the instruction apparatus shown in FIG. 1.

As shown in FIGS. 16(A) and 16(B), as an optical image displaying stages of a work, numerical figures GN indicating the order of a plurality of stages in consecutive numbers can be adopted. In the example shown in FIGS. 16(A) and 16(B), a plurality of stages required to complete one sub-assembly is displayed initially (see FIG. 16(A)). After the execution of the stages of the sub-assembly terminates, a plurality of stages required to bind (complete) a subsequent sub-assembly is displayed in consecutive numbers (see FIG. 16(B)). An initial display of one sub-assembly is switched to a subsequent display thereof (switching from the condition of FIG. 16(A) to that of FIG. 16(B) by means of a timer. In this case, individual displays make the display of a plurality of stages. Thus, it is possible to reduce a time lag between a time set to switch stages and an actual work time to a smallest extent possible.

Figure 17A:
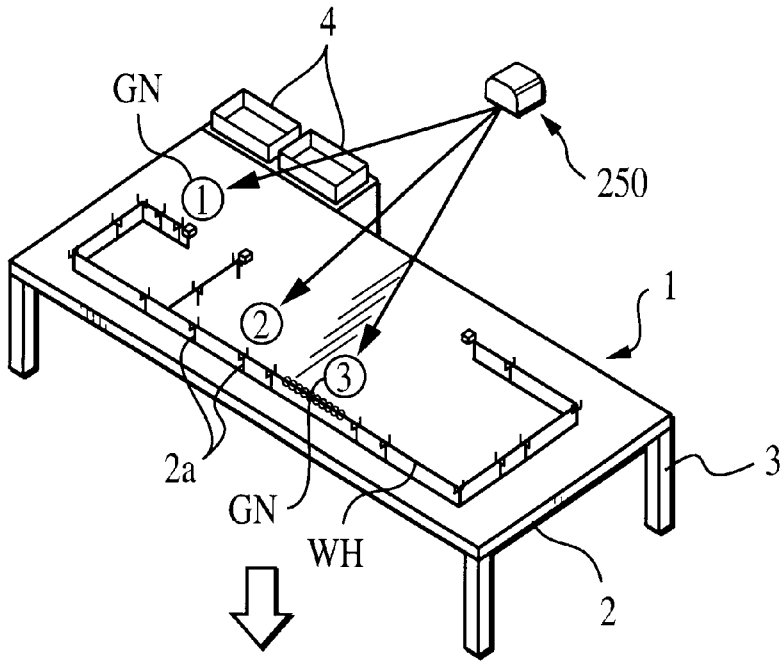
FIG. 17(A) and 17(B) are perspective views corresponding to FIGS. 10(A) and (B) showing still another display mode to be carried out by using the instruction apparatus shown in FIG. 1.
Figure 17B:
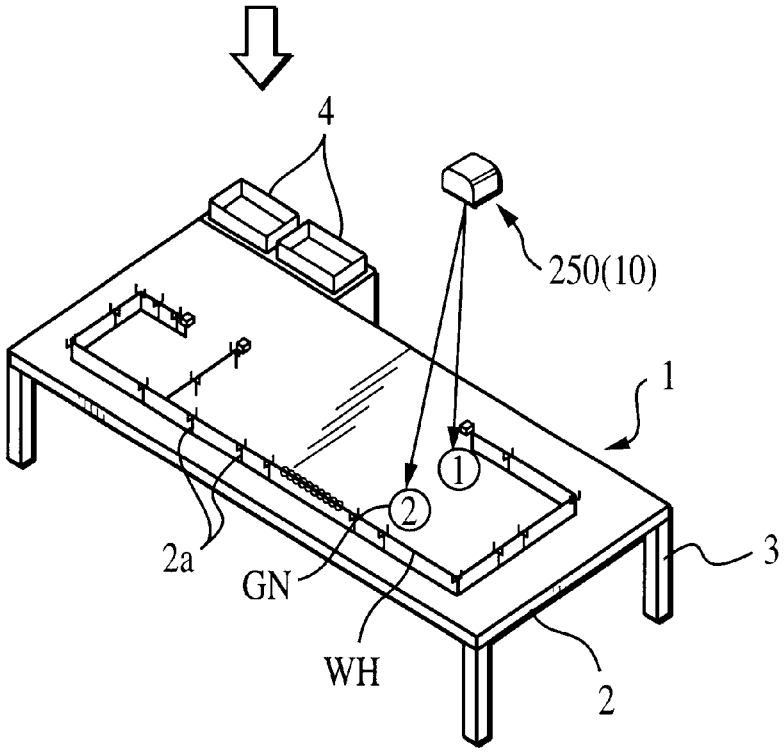

FIGS. 17(A) and 17(B) are perspective views showing still another display mode to be carried out by using the instruction apparatus shown in FIG. 1.

An optical image shown in FIGS. 17(A) and 17(B) is displayed as an arrow GA displaying switching from one stage to a subsequent stage. In this case, in taking out component parts from any one of the plurality of receptacles 4 and installing them on the wire harness at predetermined positions thereof, the receptacle 4 accommodating the component parts is displayed at the root (rear) side of the arrow GA and a corresponding position of the wire harness is displayed with the arrow GA at its front side. Thereby, the component removal stage and the component installing condition are simultaneously displayed. Similarly to the mode of FIGS. 16(A) and 16(B), the receptacle 4 of the following stage and a corresponding position are displayed with another optical image.

Figure 18:
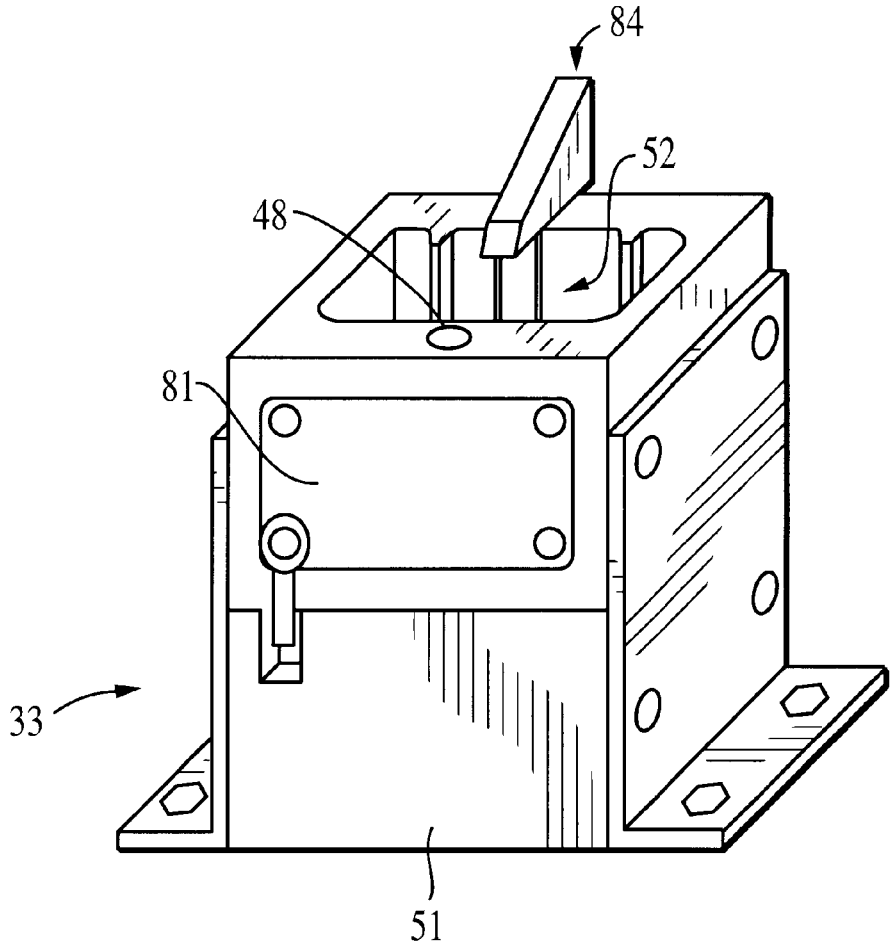
FIG. 18 is a perspective view of a wire insertion-detecting jig another display mode to be carried out by using the instruction apparatus of FIG. 1.

According to a further embodiment of the invention, a plurality of jigs 33 (one is shown in FIG. 18) are mounted on the wiring plate 2 of the apparatus shown in FIG. 1. Each jig 33 is operatively connected to the control unit 20 in a manner similar to that disclosed in commonly owned, copending U.S. application Ser. No. 09/628,057. Each jig 33 includes a jig main body 51 having a connector receiving portion 52 that is configured to receive a connector (not shown) to be wired, and a plurality of probe pins (not shown) are provided within the connector receiving portion and connected to the control unit 20 for purposes to be described later. A locking member 84 is provided on the main body 51 to lock the connector within the jig 33. A single LED 48 is provided on each jig 33 and is connected to the control unit 20 to indicate to the operator which jig 33 is to receive assembly work according to a particular working order. Each jig 33 also includes a touch plate 81 provided on the side of the main body 51 and connected to the control unit 20, for purposes to be described later.

In use, the jigs 33 are provided with an appropriate connector (not shown) according to the wire assembly procedure to be performed as programed in the control unit 20. Each connector typically has a plurality of cavities that are to receive terminals of wires or other components that may be intended to be connected to cavities in another such connector. The control unit 20 is programed to initially simultaneously illuminate a cavity of a connector into which a first end terminal of a wire or other component is to be inserted and a receptacle 4 that contains the wire or other component to be utilized. The control unit 20 is also programed to provide an indication to the operator, for example by an audible or visible signal, that a proper insertion of the terminal in the first connector has been accomplished, or, alternatively, to provide an audible or visible a warning indication that an improper insertion has been performed so that the terminal can be withdrawn and replaced in the proper cavity. In this regard, the terminal end that is inserted into a cavity contacts the respective probe pin of the jig 33 which relays to the control unit 20 the position of the cavity into which the terminal end has been inserted. When a proper insertion has been performed, the control unit 20 then indicate to the operator the location of another cavity of the same connector or another cavity of a different connector in a different jig 33 that is to receive a second end terminal of the wire or other component.

In accordance with the embodiment utilizing the jigs 33 of FIG. 18, the laser beam emission unit 150 is utilized to illuminate only the particular cavity of the connector that is to receive the terminal end to be inserted. The laser beam is focused in such a manner to indicate only a single such cavity, and preferably the illumination pattern of the laser beam is in the shape of cross hairs (+). Such a pattern enables easy initial setup and programing of the control unit 20, as well as a clear identification to the operator of the particular cavity in which the terminal end is to be inserted.

At the same time the cavity of the connector is being illuminated, the component receptacle 4 from which a component part to be removed is simultaneously illuminated, for example by a flashing light, such as an LED, to indicate to the worker which component to select to insert into the cavity that is being simultaneously illuminated by the laser.

Once the first terminal end of the component has been properly inserted into the illuminated cavity, the control unit 20 automatically controls the laser beam emission unit 150 to move the illumination pattern to the next cavity to be selected. If a second jig 33 has been provided with a connector, the touch plate 81 of the second jig 33 is touched with the second terminal end of the component to be inserted, which signals the control unit 20 that insertion of the first end is completed, so that the control unit then directs the laser beam emission unit to illuminate the proper cavity of the second connector that is to receive second terminal end of the component.

Each time the operator intends to insert the second terminal end of a wire from a first connector into the proper cavity of a second connector, the operator must touch the terminal to the touch plate 81 on the jig 33 holding the second connector. The reason for this is that the control unit 20 is programmed and operatively connected to the touch plate 81 so that when the touch plate 81 on the side of the jig 33 is contacted by the second terminal end, the control unit 20 knows which cavity is to be the appropriate cavity to be connected. No particular order is necessary to connect the second terminal end of the connector because the control unit 20 automatically selects the appropriate cavity.

Once the second terminal end has been properly inserted into the cavity illuminated by the laser beam, the control unit provides an indication to the operator, for example by an audible or visible signal, that a proper insertion of the terminal in the first connector has been accomplished or alternatively a warning indication that an improper insertion has been performed so that the terminal can be withdrawn and replaced in the proper cavity. When a proper insertion of the second terminal end has been performed, the control unit 20 then indicates to the operator another cavity of a connector that is to receive an end terminal of another wire or other component to be installed in the connector, as well as the component to be selected from an appropriate receptacle 4, again by simultaneously illuminating the selected cavity by the laser beam and the appropriate receptacle 4 by any desired illumination device, such as an LED. The above process then continues until the assembly of the connector or connectors is complete.

Of course, although the above process has been described as being used with the jigs 33 configured to receive connectors, it should be clear that such jigs can be configured to receive any suitable component to be assembled.

Furthermore, although the illumination device has been described as a laser beam, it should also be apparent that any suitable illumination device that is capable of providing a discrete illumination pattern, such as cross hairs, may be utilized. Also, the illumination pattern having the shape of cross hairs may be formed by a plate which is a +-shaped slit formed therein that is positioned at the output of the laser in the laser holder.

Additionally, the control unit 20 is programmed by manually controlling operation of the X-axis and Y-axis stepping motors until the cross hairs of the laser are centered precisely on the cavity to be illuminated. Then a memory button is actuated to store the position of the first cavity in the control unit 20. After the first cavity is programmed for one connector, the next step is to program the location of the cavity in the second connector at the second jig in the same manner. These steps are performed alternatingly back and forth until each cavity in each connector that needs to be connected has been identified and its position has been stored in the control unit 20.

As described above, according to the present invention, because sequences of a plurality of assembly operations are displayed simultaneously, a display position-switching operation to be performed by using visible light is eliminated to a high extent. Therefore, it is possible to support the assembly operations of manufacturing the wire harness which should be performed in complicated stages. Further, because in switching a display position by using a timer, a plurality of stages are displayed simultaneously, the timer can be set easily and it is possible to prevent a time lag from occurring between a time period set for the timer and an actual assembly operation time period required for an operator to finish the assembly operation. Therefore, the present invention has an outstanding effect of displaying the manufacturing procedure of the wire harness with a simple construction.

Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

The present disclosure relates to subject matter contained in priority Japanese Application Nos. HEI 11-286676, filed on Oct. 7, 1999, and HEI 2000-004326, filed Jan. 13, 2000, which are herein expressly incorporated by reference in their entireties.

What is claimed is:

1. A method of directing the assembly of a wire harness by wiring electric wires on a wiring plate with visible light, said method comprising:

illuminating a to-be-assembled portion of the wire harness related to the procedure simultaneously with a component part-accommodating portion related thereto in pairs with said visible light, such that an assembler is directed to said to-be-assembled portion and said component part-accommodating portion to perform the assembly.

2. The method according to claim 1, wherein said visible light is emitted simultaneously linearly by pivoting a light source.

3. The method according to claim 1, wherein said visible light is emitted simultaneously by a plurality of light sources.

4. The method according to claim 1, wherein said visible light is emitted by a light source to a required portion in only a standard assembly time period set in correspondence to the procedure.

5. The method according to claim 2, wherein said visible light is emitted by a light source to a required portion in only a standard assembly time period set in correspondence to the procedure.

6. The method according to claim 3, wherein said visible light is emitted by a light source to a required portion in only a standard assembly time period set in correspondence to the procedure.

7. The method according to claim 1, wherein said visible light is emitted by a light source to provide an illumination pattern in the shape of a cross-hair.

8. A work-performing instruction apparatus comprising:

a light source that emits visible light;

a first holder pivotally mounting said light source on a first axis;

a light source-driving member provided on said first holder to pivot said light source on said first axis;

a second holder pivotally mounting said first holder on a second axis orthogonal to said axis;

a second holder-driving member for pivoting said first holder on said second axis; and a controller that controls said light source-driving member and said second holder-driving member such that a to-be-assembled portion related to an assembly procedure and a component accommodating portion related thereto are simultaneously illuminated in pairs with the visible light, such that an assembler is directed to the to-be-assembled portion and the component part-accommodating portion to perform the assembly.

9. The work-performing instruction apparatus according to claim 8, wherein said light source-driving member includes a reduction gear, and further comprising an elastic member provided between said first holder and said light source to prevent backlash associated with said reduction gear.

10. The work-performing instruction apparatus according to claim 8, wherein said light source-driving member is cantilever-mounted on said second holder driving member so that said second holder-driving member receives a load of the light source-driving member and that of the first holder so that the load provides sufficient backlash prevention, and no additional backlash prevention device is necessary to prevent backlash associated with said second holder-driving member.

11. The work-performing instruction apparatus according to claim 8, wherein said visible light is emitted by said light source to provide an illumination pattern in the shape of a cross-hair.

12. A method utilizing visible light to direct the assembly of a wire harness by wiring electric wires on a wiring plate, said method comprising:

illuminating a plurality of work positions simultaneously with said visible light and displaying an assembly procedure related to each work position with an optical image formed by scanning the work positions, such that an assembler is directed to the work position and informed of the assembly procedure to perform the assembly.

13. The method according to claim 12, wherein said illuminating comprises displaying a plurality of work positions with optical images of consecutive numerical values formed of said visible light in correspondence to the order of assembly.

14. The method according to claim 12, wherein said illuminating comprises displaying an outline drawing of said wire harness with an optical image formed of said visible light.

15. The method according to claim 12, wherein said illuminating comprises emitting said visible light to provide an illumination pattern in the shape of a crosshair.

16. A method of directing the connecting of terminal ends of a component to a connector using visible light, said method comprising:

simultaneously illuminating a terminal end receiving cavity of the connector and indicating the component to be connected thereto with said visible light, such that an assembler is directed to the terminal end receiving cavity and informed of the component to be connected thereto to perform the connection.

17. The method according to claim 16, wherein said visible light is emitted simultaneously linearly by pivoting a light source.

18. The method according to claim 16, wherein said visible light is emitted simultaneously by a plurality of light sources.

19. The method according to claim 16, wherein said visible light is emitted by a light source to a required portion in only a standard assembly time period set in correspondence to the procedure.

20. The method according to claim 17, wherein said visible light is emitted by a light source to a required portion in only a standard assembly time period set in correspondence to the procedure.

21. The method according to claim 18, wherein said visible light is emitted by a light source to a required portion in only a standard assembly time period set in correspondence to said procedure.

22. The method according to claim 16, wherein said visible light is emitted by a light source to provide an illumination pattern in the shape of a cross-hair.

23. The method according to claim 16, further comprising providing at least one jig having a portion for receiving the connector;

emitting said visible light from a motor actuated light source to selectively illuminate any one of a plurality of terminal end receiving cavities in the connector; and controlling, with a control unit, actuation of said motor actuated light source to enable the selective illumination of the cavities in the connector, and simultaneously controlling, with said control unit, indicating the selected component to be connected to the connector.

24. The method according to claim 23, wherein said indicating of the component comprises emitting light from a light source provided on a receptacle that houses the selected component simultaneously with said visible light emitted from said motor actuated light source.

25. The method according to claim 24, wherein said control unit responds to insertion of a first terminal end of the component into the illuminated cavity to actuate said motor actuated light source to indicate another connector cavity into which a second terminal end is to be inserted and to simultaneously indicate a next component to be selected for connecting to the connector.

26. The method according to claim 25, wherein said control unit responds to insertion of a second terminal end into the another cavity to restart the instructing of the procedure until all desired components have been connected to appropriate connectors.

27. The work-performing instruction apparatus according to claim 8, wherein said to-be-processed portion comprises a portion of a wire harness.

28. The work-performing instruction apparatus according to claim 8, wherein said to-be-processed portion comprises a cavity of a connector.

29. The work-performing instruction apparatus according to claim 8, further comprising at least one jig mounted on a work plate to receive the connector and hold the same in a fixed position.

30. The work-performing instruction apparatus according to claim 29, wherein said jig is operatively connected to said controller in order to feed back information to said controller regarding assembly of the component and the connector.

* * * * *